US008109347B2

(12) United States Patent
Jhin et al.

(10) Patent No.: US 8,109,347 B2
(45) Date of Patent: Feb. 7, 2012

(54) CORE CATCHER AND CORER HAVING IT

(75) Inventors: Jae Hwa Jhin, Daejeon (KR); Jun Ho Kim, Mokpo-si (KR); Min Jun Kim, Daejeon (KR)

(73) Assignee: Korea Institute of Geoscience and Mineral Resources (KIGAM), Daejeon (KR)

( * ) Notice: Subject to any disclaimer, the term of this patent is extended or adjusted under 35 U.S.C. 154(b) by 217 days.

(21) Appl. No.: 12/599,032

(22) PCT Filed: May 26, 2008

(86) PCT No.: PCT/KR2008/002921

§ 371 (c)(1),
(2), (4) Date: Nov. 5, 2009

(87) PCT Pub. No.: WO2009/057870

PCT Pub. Date: May 7, 2009

(65) Prior Publication Data

US 2010/0133014 A1 Jun. 3, 2010

(30) Foreign Application Priority Data

Oct. 31, 2007 (KR) ..... 10-2007-0109944

(51) Int. Cl.
*E21B 25/06* (2006.01)

(52) U.S. Cl. ..... 175/249; 175/58

(58) Field of Classification Search ..... 175/20, 175/58, 246, 249
See application file for complete search history.

(56) References Cited

U.S. PATENT DOCUMENTS

| | | | | | |
|---|---|---|---|---|---|
| 1,797,550 | A | * | 3/1931 | Hamaker | 175/249 |
| 2,103,611 | A | * | 12/1937 | Catland et al. | 294/86.29 |
| 3,952,817 | A | * | 4/1976 | Anderson | 175/240 |
| 4,667,753 | A | * | 5/1987 | Jageler | 175/244 |
| 5,211,249 | A | | 5/1993 | Richter et al. | |

FOREIGN PATENT DOCUMENTS

| | | | |
|---|---|---|---|
| JP | 5-3394 | U | 1/1993 |
| JP | 05-003394 | U | 1/1993 |
| JP | 2005-69950 | A | 3/2005 |
| JP | 2005-069950 | A | 3/2005 |
| KR | 20-0328820 | Y1 | 10/2003 |

* cited by examiner

*Primary Examiner* — William P Neuder
(74) *Attorney, Agent, or Firm* — The Webb Law Firm

(57) ABSTRACT

The present invention relates to a core catcher and a corer having the same, and more particularly, to a core catcher provided with dual blade radial pins for preventing loss of sediments and a corer having the same.

5 Claims, 7 Drawing Sheets

(a) (b)

[Figure 1]
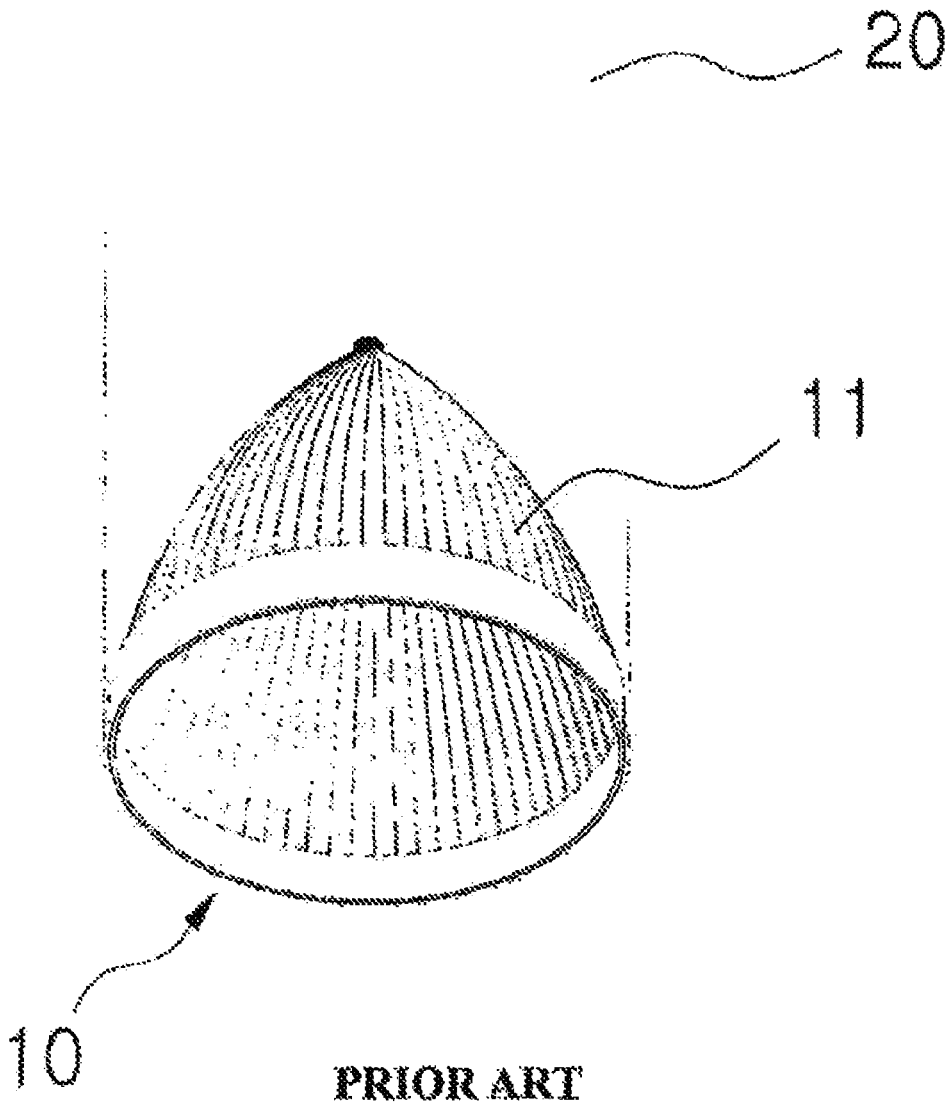
PRIOR ART

【Figure 2】
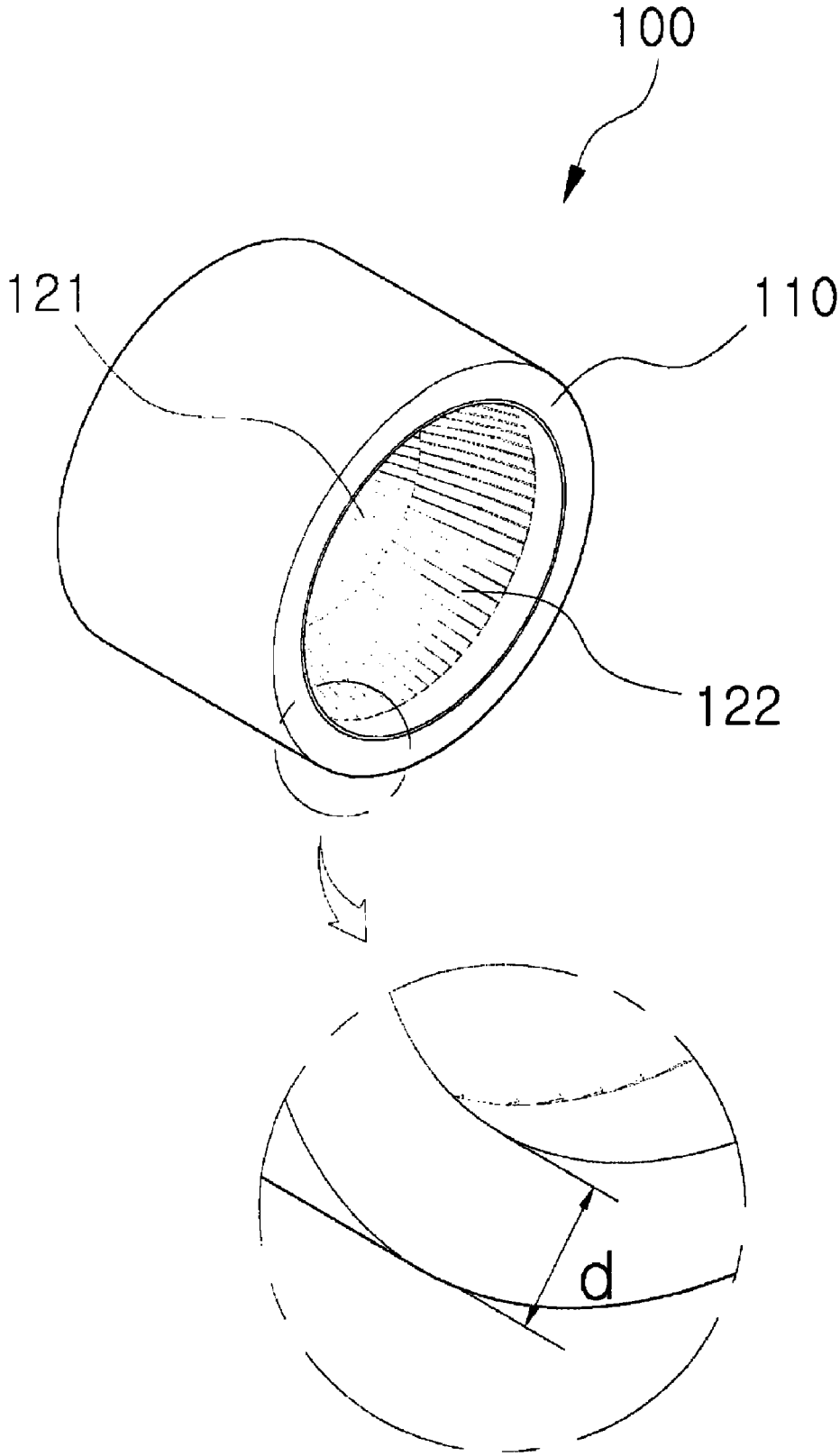

【Figure 3】
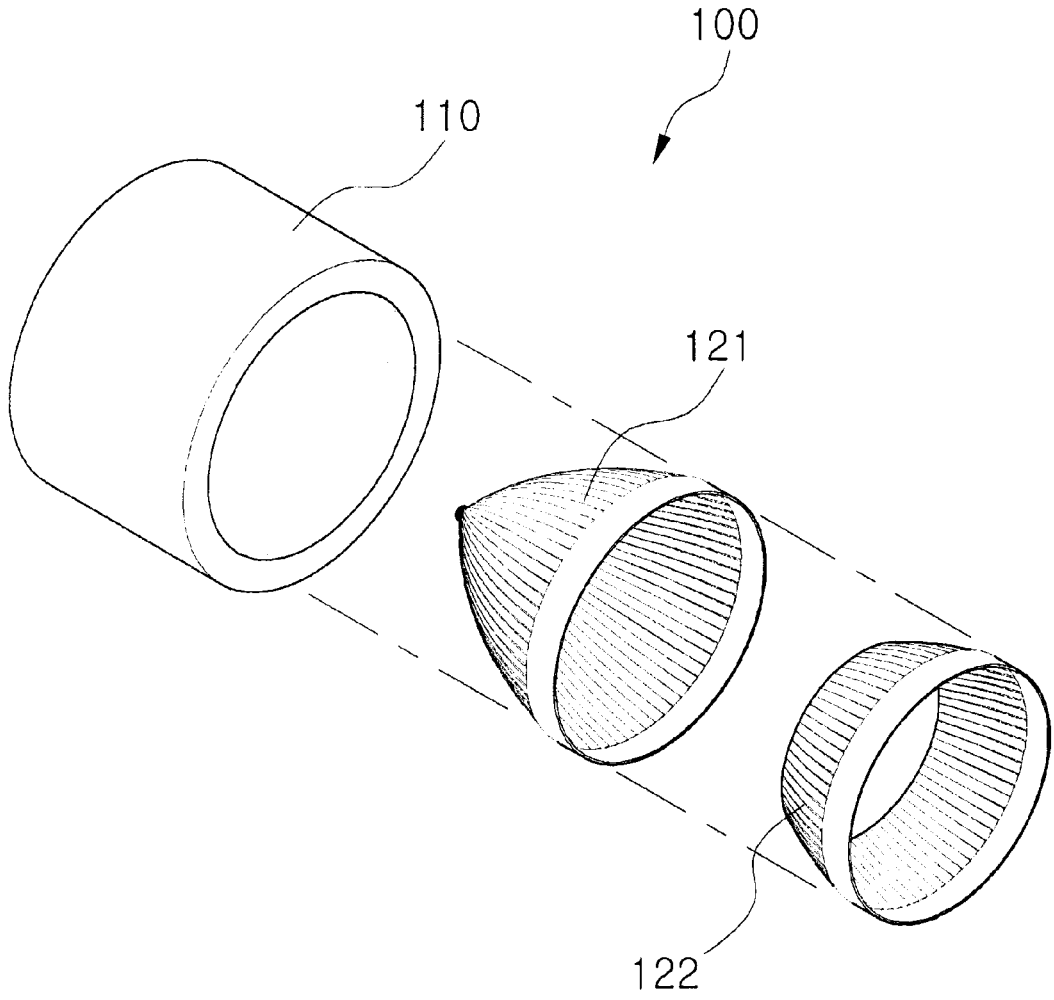

【Figure 4】
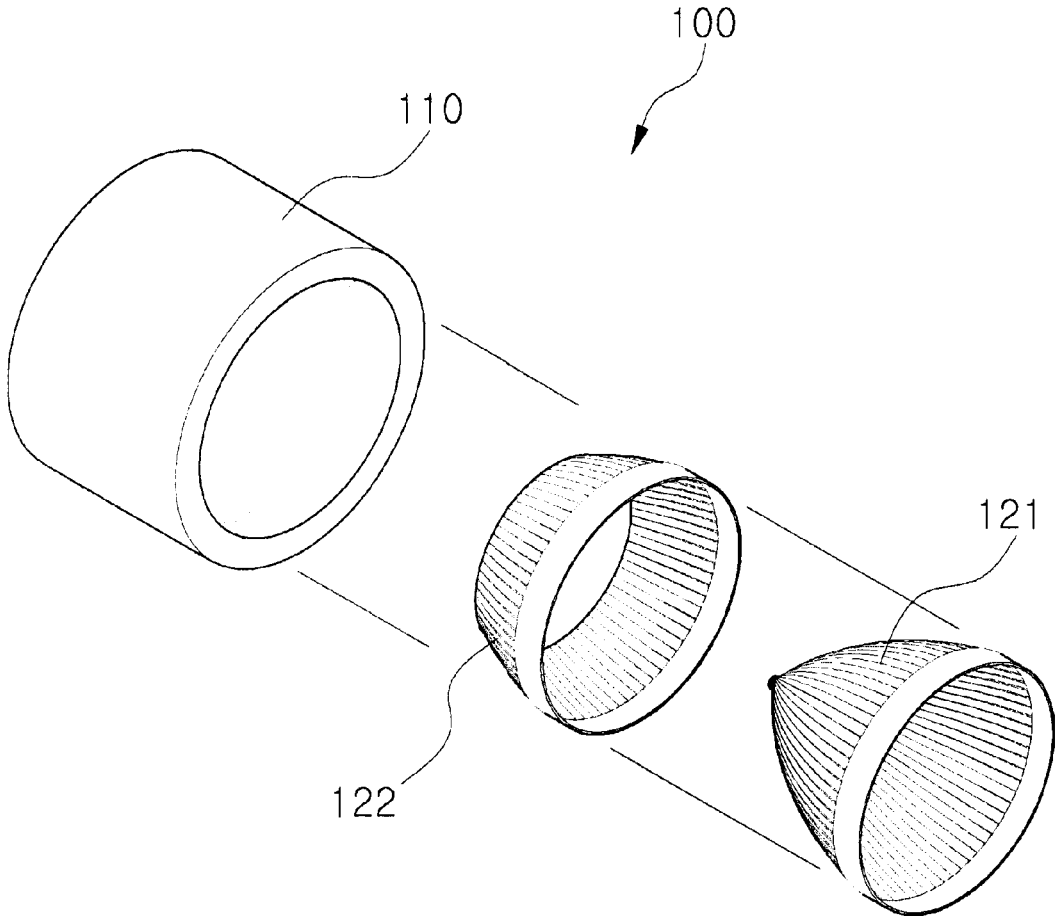

【Figure 5】
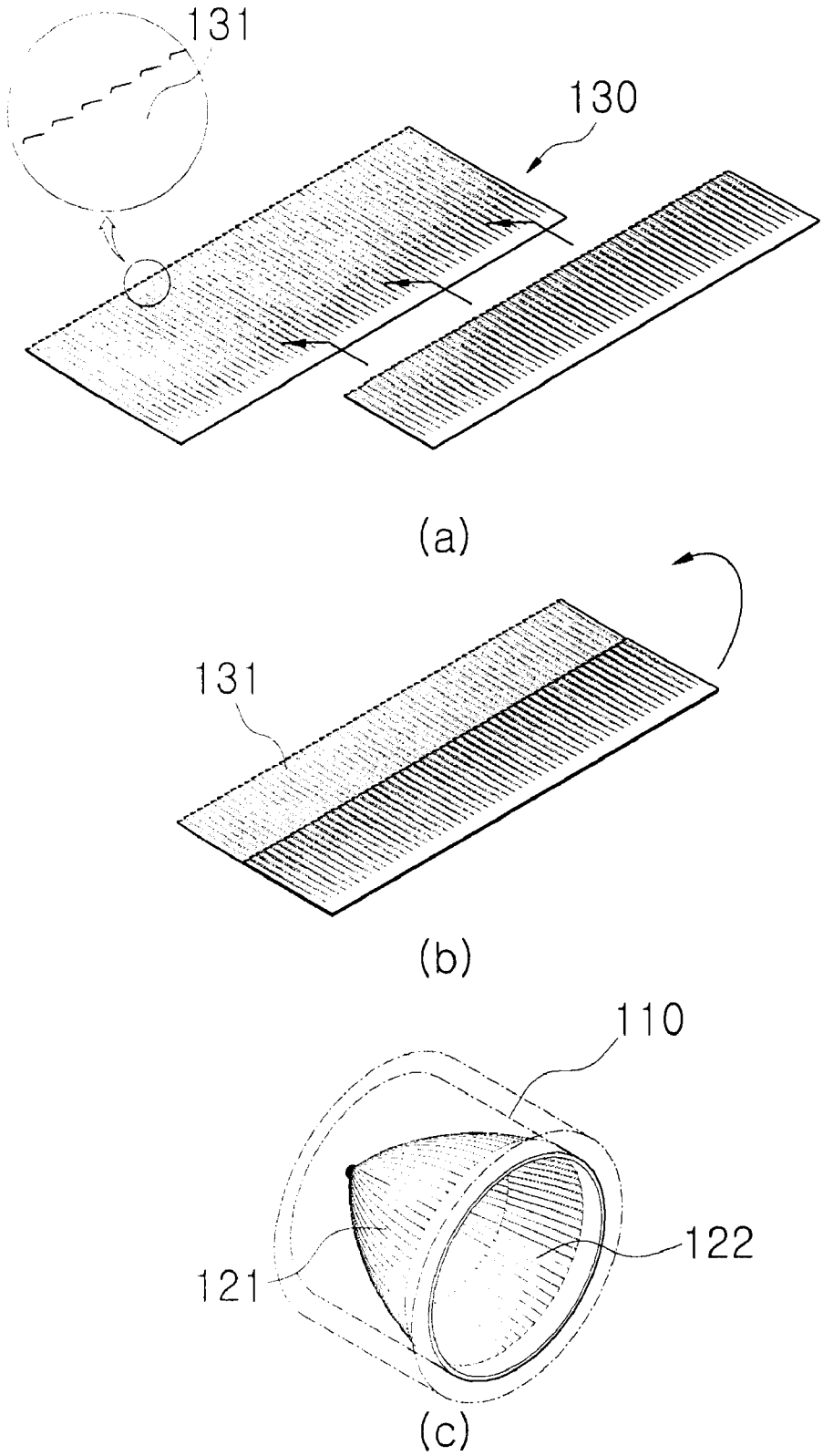

[Figure 6]
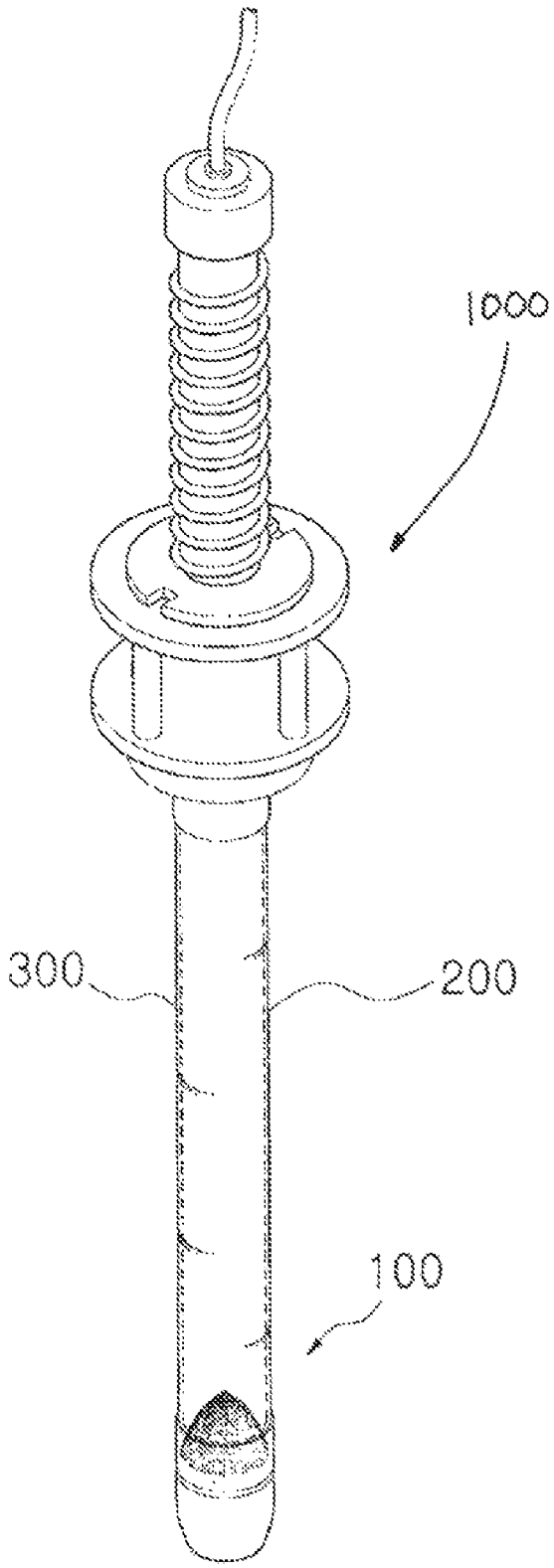

【Figure 7】
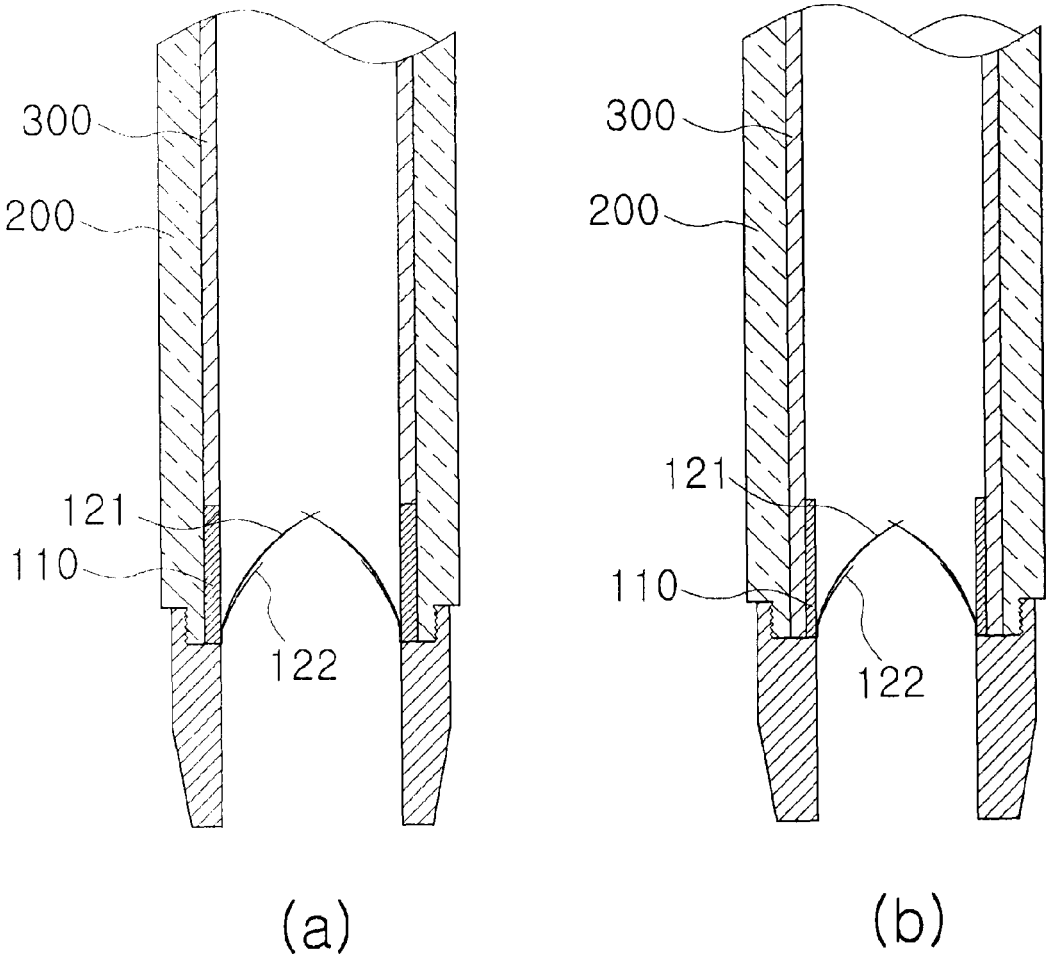

CORE CATCHER AND CORER HAVING IT

TECHNICAL FIELD

The present invention relates to a core catcher and a corer having the same, and more particularly, to a core catcher provided with dual blade radial pins for preventing loss of sediments and a corer having the same.

BACKGROUND ART

In general, continuously deposited sedimentary layers are formed on the base of river, lake or sea, and an inspection of sediments in the sedimentary layers aids to understand the ecosystem of the corresponding era and thus analogize the history and environment of the earth.

As such, it is important to take the sediments of the continuous sedimentary layers for studying the sedimentary layers, and a corer is generally used to take a sample of the continuous sedimentary layers.

The corer is divided into a vibracorer that uses vibration, a free-fall gravity corer that uses free-fall, a piston corer, a box corer and so on.

The vibracorer is mainly used to take the sediments in coast such as a lake, a marshy land and a foreshore, and the coring depth is generally about 5 m though it is variable as particles in the sediments.

The free-fall gravity corer is provided with a weight for applying a predetermined load and thus takes the sediments not using an external power but by a self-load of the weight. However, since the weight should also be pulled up when the sediment is pulled up after the sediment is taken, a large power is needed for the pulling up operation.

The piston corer is of a type that is used to take sedimentary layers having a large depth in a sea floor, and the sedimentary layers having maximum depth of 38 m Marion survey vessel in France has been reportedly taken.

The box corer is that is designed to prevent an error resulted from agitation or removal of the upper part of the sedimentary layers, and is able to take the sedimentary layers having about 50 cm.

Although the corer is formed in various forms according to its objective, the corer is generally formed with a sediment taking part at a lower portion thereof and the sediment taking part is provided with a chuck for allowing a corer body to be inserted deep into the sedimentary layers, a sample case connected to the chuck and taking the sediment therein, and a core catcher for preventing the loss of the sediments taken in the sample case.

FIG. 1 is a partial perspective view illustrating the sediment taking part of the conventional corer.

The conventional core catcher 10 as shown in FIG. 1 is provided a plurality of radial pins 11 that extend radially to the inside of the sample case 20 and made of elastic material, and the radial pins 11 allow the sediment to be easily inputted into the sample case when the corer is inserted into the sedimentary layers and prevent the loss of the sediments when the corer is pulled up.

However, since the sample case is not always filled full although the core catcher having the radial pins, the sediments at the lower side is apt to be lost and thus the sedimentary layers are apt to be deformed when the corer is pulled up. Particularly, fine-grained sand or the like is apt to be flowed down. Therefore, the corer is generally provided with a pressure regulating part for properly maintaining the pressure inside the sample case.

However, in the case that the core catcher is formed in the single blade type, some sediment is caught between the radial pins when the corer is inserted into the sedimentary layers, and a gap is formed by the fine-grained sand and causes loss of the sediments therebetween. Therefore, the problem resulted from the loss of the sediments has not yet been solved.

Particularly, the problem is largely generated when coring the sediments with particles larger than the fine-grained sands or when the depth of the sedimentary layer to be taken is deep, and the sediment is caught between the pins to generate the gap at the periphery of the radial pins and areas adjacent thereto than at the center of the radial pins.

Also, since the core catcher is not a separate component and is adhered to the lower portion of the sample case, a predetermined lower area of the sample case cannot be used to take the sediments. Therefore, a separate corer may be required according to the coring environment.

DISCLOSURE

Technical Problem

An object of the present invention is to provide a core catcher that is provided with first radial pins and second radial pins to prevent loss of sediments taken in the inside of a sample case, thereby raising accuracy of study to the sediments, and a corer having the same.

Another object of the present invention is to provide a core catcher that is removably attachable to a liner provided in the inside of the sample case thereby allowing various sizes and shapes of core catchers to be attachable according to material to be taken and that prevents removal of an area of the sample case due to the formation of the core catcher thereby capable of easily adjusting the height of the sedimentary layers to be taken, and a corer having the same.

Technical Solution

In an aspect of the present invention, there is provided a core catcher provided at a lower end of a sample case in the inside of a corer to prevent loss of sediments taken in the inside of the sample case, wherein the core catcher includes: a body having a hollows inside; and first radial pins adhered to an inner periphery of the body and having a plurality of the elastic pins projected toward upper inner side of the body to allow introduction of the sediments toward the inside of the sample case and to be closed to prevent the loss of the sediments taken in the inside of the sample case, and second radial pins adhered to the inner periphery of the body and blocking a predetermined area of the first radial pins.

Preferably, the second radial pins are formed at an upper portion or a lower portion of the first radial pins.

Preferably, the second radial pins block 20 to 40% of total area of the first radial pins from the side at which the first radial pins are adhered.

Preferably, the body is formed in a thickness of 1 to 5 mm.

Preferably, the first radial pins and the second radial pins are respectively formed using a board formed with a plurality of cut parts except at the area to be adhered to the body.

In another aspect of the present invention, there is provided a corer including the core catcher as described above which is removably attached to a liner provided in a sample case.

Preferably, the core catcher is fitted into the lower side or the inner side of the liner.

Preferably, the corer is any one selected from a free-fall gravity corer, a vibracorer or a piston corer.

ADVANTAGEOUS EFFECTS

As described above, in the core catcher and the corer having the same, the first radial pins and the second radial pins are formed in two blade structure to prevent loss of sediments taken in the inside of a sample case, thereby raising accuracy of study to the sediments, and a separate pressure regulating part can be removed thereby simplifying the structure of the corer.

Also, in the core catcher and the corer having the same, the body having a predetermined thickness is removably attached to the liner provided in the inside of the sample case thereby capable of attaching various sizes and shapes of core catchers according to material to be taken and removal of an area of the sample case due to the formation of the core catcher is prevented thereby capable of easily adjusting the height of the sedimentary layers to be taken.

DESCRIPTION OF DRAWINGS

The above and other objects, features and advantages of the present invention will become apparent from the following description of preferred embodiments given in conjunction with the accompanying drawings, in which:

FIG. 1 is a perspective view illustrating a conventional core catcher.

FIG. 2 is a perspective view illustrating a core catcher according to an embodiment of the present invention.

FIG. 3 is an exploded perspective view illustrating the core catcher of FIG. 2.

FIG. 4 is an exploded perspective view illustrating a core catcher according to another embodiment of the present invention.

FIG. 5 is a view illustrating a method for manufacturing a core catcher according to an embodiment of the present invention.

FIG. 6 is a perspective view illustrating a corer according to an embodiment of the present invention.

FIG. 7 is a partial sectional view illustrating the corer according to an embodiment of the present invention.

DETAILED DESCRIPTION OF MAIN ELEMENTS

| | |
|---|---|
| 100: | core catcher according to an embodiment of the present invention |
| 110: | body |
| d: | thickness of body |
| 121: | first radial pins |
| 122: | second radial pins |
| 130: | board |
| 131: | cut part |
| 200: | sample case |
| 300: | liner |
| 1000: | corer according to an embodiment of the present invention |

BEST MODE

Hereinafter, a core catcher 100 and a corer 1000 having the core catcher 100 according to the present invention will be described in detail with reference to accompanying drawings.

FIG. 2 is a perspective view illustrating a core catcher 100 according to an embodiment of the present invention, and FIG. 3 is an exploded perspective view illustrating the core catcher 100 of FIG. 2.

As shown in FIGS. 2 and 3, the core catcher 100 according to an embodiment of the present invention is provided at a lower end of a sample case 200 in the inside of a corer 1000 and prevents the loss of sediments taken in the inside of the sample case 200, wherein the core catcher 100 includes a body 110 having a hollowed inside; and first radial pins 121 adhered to an inner periphery of the body 110 and having a plurality of the pins for closing the lower portion of the sample case 200 and second radial pins 122 adhered to the inner periphery of the body 110 and blocking a predetermined area of the first radial pins.

The body 110 that is a component constituting a main body of the core catcher 100 according to an embodiment of the present invention has a predetermined thickness d and is formed with a hollowed inside to allow the sediments to be introduced into the inside of the sample case 200.

Although the body 110 of the core catcher 100 in FIGS. 2 and 3 is formed in a cylindrical shape with the hollowed inside, the body 110 may be formed in various shapes and sizes according to the shape of the sample case 200 of the corer 1000.

The body 110 is preferably formed with the thickness d of through 5 mm so that the body 110 of the core catcher 100 according to an embodiment of the present invention has strength enough to support the first radial pins 121 and the second radial pins 122.

The first radial pins 121 and the second radial pins 122 are adhered to the inner periphery of the body 110 to allow introduction of the sediments toward the inside of the sample case 200 by the plurality of the pins and to prevent the loss of the sediments taken in the inside of the sample case 200 by the elastic pins.

First, the first radial pins 121 form a layer for primarily preventing the loss of the sediments, and the radial pins are projected toward upper inner side of the body 110 to be opened by an upward force and closed by a downward force.

However, in the case that the first radial pins 121 is formed alone, the pins are closely engaged together at the center side of the body 110 but gaps are formed between the plurality of the elastic pins as goes from the center side of the body 110 to the side adhered to the inner periphery of the body 110. Further, the gaps become larger when the sediments such as sands are caught between the elastic pins. Therefore, the sediments taken in the inside of the sample case may be lost when the corer 1000 is pulled up.

The second radial pins 122 are formed, to solve the problem in the case that the first radial pins 121 are formed alone, at an upper portion or a lower portion of the first radial pins 121 so as to block a predetermined area of the first radial pins 121.

The second radial pins 122 are adhered, like the first radial pins 121, to the inner periphery of the body 110, and block the area in that gaps are frequently generated between the elastic pins of the first radial pins 121.

The second radial pins 122 are preferably formed so as to block 20 to 40% of total area of the first radial pins 121 from the side at which the first radial pins 121 are adhered.

When the second radial pins 122 are formed in less than 20% of the total area of the first radial pins 121, effect of preventing the loss of the sediments by the second radial pins 122 is insufficient. On the contrary, when the second radial pins 122 are formed in more than 40% of the total area of the first radial pins 121, the second radial pins 122 may rather obstruct the function that the first radial pins 121 are closed by the second radial pins 122 to prevent the loss of the taken sediments. Therefore, the second radial pins 122 are formed so as to block 20 to 40% of the total area of the first radial pins 121 from the side at which the first radial pins 121 are adhered.

The area is determined based on how much the second radial pins 122 blocks the first radial pins 121 in height when unfolding the first radial pins 121 and the second radial pins 122 on a plane.

Although the second radial pins 122 are formed at the lower portion of the first radial pins 121 in FIGS. 2 and 3, the second radial pins 122 may be formed at the upper portion of the first radial pins 121 as shown in FIG. 4.

In the case that the second radial pins 122 are formed at the lower portion of the first radial pins 121, the phenomenon that the sediments are caught in the first radial pins 121 when taking the sediments i.e. when the corer is moved down can be prevented. In the case that the second radial pins 122 may be formed at the upper portion of the first radial pins 121, the loss of the sediments can be prevented by the second radial pins 122 even though the sediments are caught in the first radial pins 121 when taking the sediments.

FIG. 5 is a view illustrating a method for manufacturing a core catcher according to an embodiment of the present invention. The core catcher 100 according to an embodiment of the present invention may be manufactured through a forming a plurality of elastic pins by forming a plurality of cut parts 131 on a board except at the side portion to be adhered; b forming base material for the first radial pins 121 and the second radial pins 122 by bending the plurality of elastic pins formed by the cut parts 131 in a predetermined direction; and c adhering the first radial pins 121 and the second radial pins 122 to the inside of the hollowed body having the predetermined thickness d.

At this time, the board 130 for forming the first radial pins 121 is formed larger in height than the board 130 for forming the second radial pins 122. The method shown in FIG. 5 is only an example and is not limited thereto provided that the method can form the first radial pins 121 and the second radial pins 122 for blocking a predetermined area of the first radial pins 121 in two blade structure.

FIG. 6 is a perspective view illustrating a corer according to an embodiment of the present invention. In the corer 1000 according to an embodiment of the present invention, the core catcher 100 having two blade structure of the first radial pins 121 and the second radial pins 122 is removably attached to the liner 300 provided in the inside of the sample case 200.

Since the corer 1000 can be generally applied to various types of corer 1000 according to properties and height of the sedimentary layers to be taken, the corer 1000 may be actually applied to any one selected from a free-fall gravity corer 1000, a vibracorer 1000 or a piston corer.

Also, since the sample case 200 is made using material such as hard stainless steel and thus the sample case should be cut to inspect the cored sedimentary layers, the liner 300 is provided in the inside of the sample case 200 to facilitate the inspection of the sedimentary layers and allow recycle of the sample case 200.

FIG. 7 is a partial sectional view illustrating the corer 1000 according to an embodiment of the present invention. The corer 1000 shown in a of FIG. 7 is of a type that the core catcher 100 is provided at the lower side of the liner 300 and the corer 1000 shown in b of FIG. 7 is of a type that the core catcher 100 is provided at the inner side of the liner 300.

In the corer 1000 of the type shown in a of FIG. 7, the thickness d of the body 110 of the core catcher 100 is preferably determined as same level as the thickness of the liner 300. In the corer 1000 of the type shown in b of FIG. 7, the thickness d of the body 110 of the core catcher 100 should be determined so that the core catcher 100 does not obstruct the introduction of the sediments.

The core catcher 100 may be fitly attached to the liner 300, but any other attaching method such as rotational attachment may be used provided that the core catcher 100 can be removably attached to the liner 300.

Since the corer 1000 according to an embodiment of the present invention is provided with a core catcher 100 capable of preventing the sediments from being lost downwardly, the corer 1000 can be applied to the piston corer 1000 in which a height of the sedimentary layers to be taken is large and a structure of a separate pressure regulating part can be reduced or be removed.

Also, since the core catcher 100 is fitly mounted into the lower side or inner side of the liner 300, a variety of the core catchers 100 can be used according to various coring conditions.

Although specific embodiments of the present invention have been described for illustrative purposes, those skilled in the art will appreciate that various modifications, additions and substitutions are possible, without departing from the scope and the spirit of the invention as disclosed in the accompanying claims.

The invention claimed is:

1. A core catcher provided at a lower end of a sample case in the inside of a corer to prevent loss of sediments taken in the inside of the sample case, wherein the core catcher includes:

a body having an inside that is hollow; and first radial pins adhered to an inner periphery of the body and having a plurality of elastic pins projected toward an upper inner side of the body to allow introduction of the sediments toward the inside of the sample case and to be closed to prevent the loss of the sediments taken in the inside of the sample case, and second radial pins adhered to the inner periphery of the body to block a predetermined area of an upper or lower portion of the first radial pins, and wherein the second radial pins block 20 to 40% of a total area of the first radial pins from the side at which the first radial pins are adhered, and wherein the first radial pins and the second radial pins are respectively formed using a board with a plurality of cut parts, except at the area to be adhered to the body, the respective first and second radial pins having a constant width in a longitudinal direction of the respective first and second radial pins.

2. The core catcher as set forth in claim 1, wherein the body is formed in a thickness of 1 to 5 mm.

3. A corer, comprising the core catcher as set forth in claim 1, the core catcher removably attached to a liner provided in a sample case.

4. The corer as set forth in claim 3, wherein the core catcher is fitted into the lower side or the inner side of the liner.

5. The corer as set forth in claim 4, the corer is any one selected from a free-fall gravity corer, a vibracorer or a piston corer.

* * * * *